US005365499A

United States Patent [19]

Sell

[11] Patent Number: 5,365,499

[45] Date of Patent: Nov. 15, 1994

[54] CLOCK WITH LID-ACTIVATED SNOOZE ALARM

[75] Inventor: Anthony Sell, Crystal Lake, Ill.

[73] Assignee: Spartus Corporation, Arlington Heights, Ill.

[21] Appl. No.: 236,593

[22] Filed: Apr. 29, 1994

[51] Int. Cl.[5] ..... G04B 23/00

[52] U.S. Cl. ..... 368/262; 368/72; 368/244; 368/250; 368/264

[58] Field of Search ..... 368/72–74, 368/244, 250, 262, 264, 263, 101–113

[56] References Cited

U.S. PATENT DOCUMENTS 1,381,225 6/1921 Pfeifer, Jr. ..... 368/262
4,282,596 8/1981 Siefert et al. ..... 368/262
5,050,140 9/1991 Aubert ..... 368/73

*Primary Examiner*—Bernard Roskoski
*Attorney, Agent, or Firm*—Seidel, Gonda, Lavorgna & Monaco

[57] ABSTRACT

A snooze alarm clock having a housing including a depressible snooze actuator in the housing and movable between an off position and an on position. The clock has a lid hingedly connected to the housing and containing a clock display. The lid has a portion which contacts the snooze actuator in the off position when the lid is in a substantially closed position relative to the housing and which rests lightly on the snooze actuator. The portion of the lid which contacts the snooze actuator depresses the snooze actuator into the on position when the lid is pressed into a fully closed position against the housing.

5 Claims, 2 Drawing Sheets

CLOCK WITH LID-ACTIVATED SNOOZE ALARM

FIELD OF THE INVENTION

The invention relates to electronic alarm clocks having a "snooze" feature, and in particular to a table clock for table, bedside, or desk which has a snooze feature that is actuatable either directly by pressing a snooze bar or indirectly by closing a lid on the clock and pressing anywhere on the lid.

BACKGROUND OF THE INVENTION

Alarm clocks with snooze features are well known. A snooze feature is desirable because it allows a user to awaken gradually over a period of several minutes, rather than be awakened abruptly. It also allows a user to temporarily turn off the alarm if the user desires additional sleep without the danger of oversleeping, since the snooze feature permits the alarm to sound again several minutes later.

Most clocks with a snooze feature have a manual actuator, usually referred to as a "snooze bar" which activates the snooze feature. Of necessity, the snooze bar is usually a large pushbutton or similar structure on the top surface of the clock, so that it is easily locatable when the user, still drowsy from being awakened, wishes to activate it. The idea is to make the snooze feature easy to activate, since the purpose of a snooze feature would be largely defeated if the user had to do much more than reach out and touch the clock. On the other hand, it would be a disadvantage if the snooze feature were too easy to activate, since this could lead to inadvertent or unwanted activation. It would also be a problem if, in fumbling for the snooze bar, a drowsy user inadvertently activated a different control button and reset the time, for example. Thus, there has been a great deal of effort devoted to solving these problems. Unfortunately, many of these solutions simply don't work well or are cumbersome and annoying to a user. For example, schemes have been employed which require the simultaneous actuation of two buttons, and which therefore require two hands, to set the time, so that inadvertently pressing one of the time set buttons instead of the snooze bar will not reset the time. Many users find these schemes less than desirable.

One approach that has been tried has been in the context of a travel alarm of the folding type, in which the clock works are hinged to a clamshell-type folding case. When the clock is set up, it forms a triangular structure in which the clock works is supported between the halves of the clamshell case. A combination snooze bar and backlight switch (for the clock display) is located on the clock works where one of the halves of the case rests on the clock works. By pressing on the case where it rests on the clock works, the switch is activated. A disadvantage of this scheme is that the clock must be set up for the switch to be actuated. There are many instances where it is desired to have the advantages of an alarm clock and a snooze feature but where, for aesthetic or other reasons, it is desired not to have a visible clock. The travel alarm described above cannot solve this problem.

There is a need, therefore, for an alarm clock which is suitable for table, bedside or desk use which is unobtrusive, decorative, and has a snooze feature which is actuatable very simply by merely pressing anywhere on the top of the clock. The present invention fills that need.

SUMMARY OF THE INVENTION

The present invention is a clock having a snooze alarm, comprising a housing and a depressible snooze actuator in the housing. The snooze actuator is movable between an off position and an on position. The clock includes a lid hingedly connected to the housing, and containing a clock display. The lid has a portion which contacts the snooze actuator in the off position when the lid is in a substantially closed position relative to the housing and which rests lightly on the snooze actuator. The portion of the lid which contacts the snooze actuator depresses the snooze actuator into the on position when the lid is pressed into a fully closed position against the housing.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
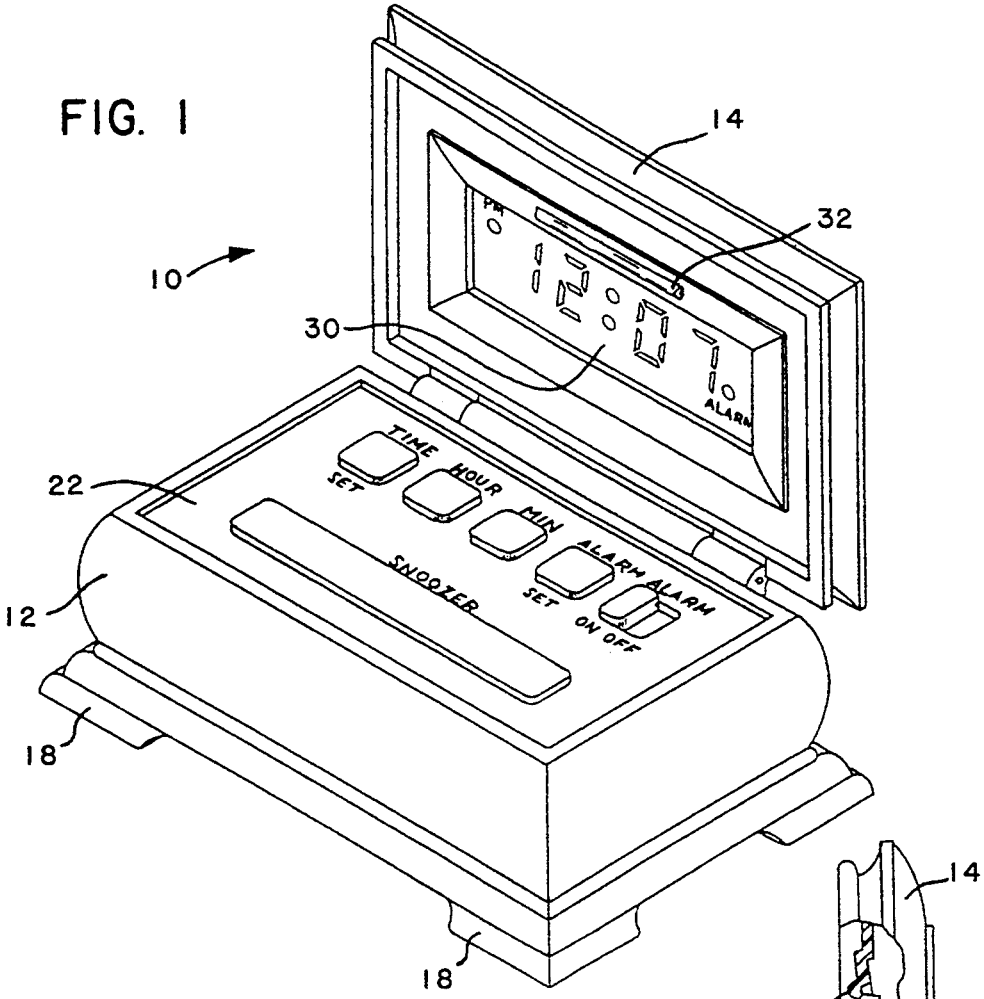
FIG. 1 is an isometric view of a clock according to the invention.

Referring now to the drawings, wherein like numerals indicate like elements, there is shown in the figures a clock 10 according to the present invention. Clock 10 comprises a housing 12 and a lid 14. Lid 14 is hingedly connected to housing 12 by a hinge 16, which may be any suitable hinge mechanism. Housing 12 may, if desired, by provided with feet 18 for supporting the clock on a convenient surface such as a table top, nightstand, desk, and the like. Housing 12 is preferably given a decorative shape and may, in addition, be provided with decorative ornamentation on its surfaces, so as to function as a decorative object as well as a timepiece.

Figure 2:
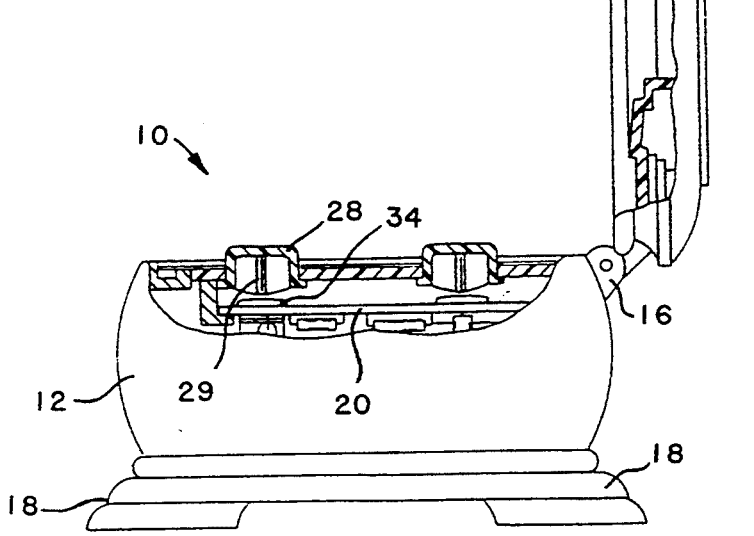
FIG. 2 is a side elevational view, partially broken away, of the clock of FIG. 1, showing relevant details of the snooze feature.

Housing 12 contains the clock works for clock 10, in the form of electronic circuitry 20, best seen in FIG. 2. Housing 12 also contains all of the user-actuated controls to operate clock 10. Thus, housing 12 supports a control pad 22 which has a plurality of pushbutton switches 24 for setting clock time and alarm time, and a slide switch 26 for turning the alarm on and off. Control pad 22 is further provided with a snooze bar 28 which actuates the snooze alarm feature of the clock.

A clock display 30 is located on the interior surface of lid 14, as best seen in FIG. 1. Display 30 is shown in the drawings as a digital display, but can, of course, be an analog dial type of display as well. Display 30 includes all of the indicia necessary to convey the time and the alarm status of the clock 10 to a user, in conventional fashion. Although not shown in the drawings, a suitable ribbon connector is provided through hinge 16 between the electronic circuitry 20 and display 30. Adjacent display 30, there is a portion of lid 14 which extends from the interior surface to form a boss 32. Boss 32 will be discussed in greater detail below.

Figure 3:
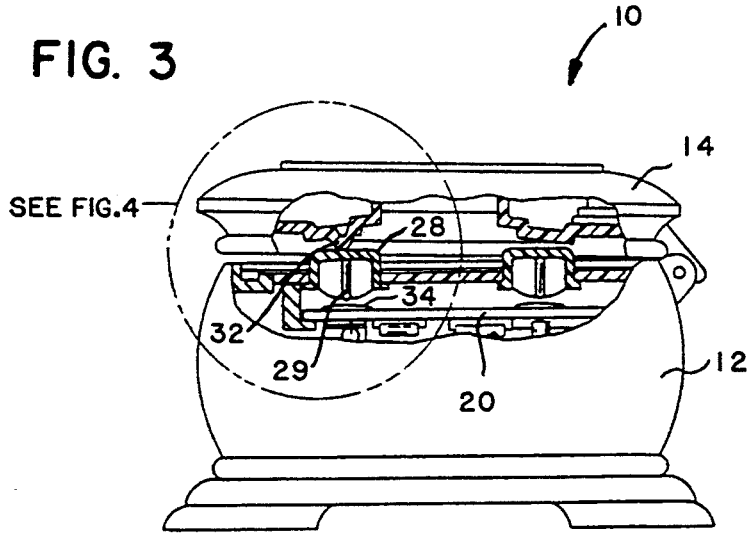
FIGS. 3 and 4 are side elevational views, also partially broken away, showing how the snooze feature is actuated.
Figure 4:
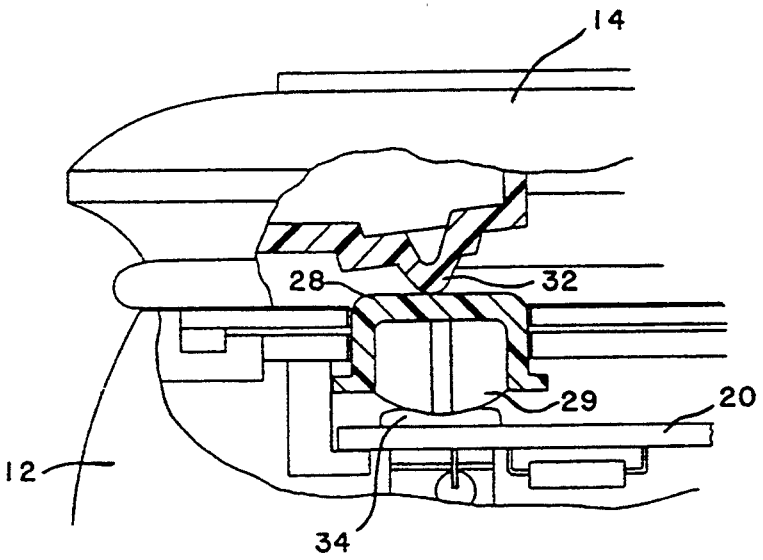

As illustrated in the figures, lid 14 is movable between a fully open position, as shown in FIG. 1, and a fully closed position, as shown in FIG. 4, and has an intermediate substantially closed position shown in FIG. 3. Of course, when lid 14 is in the fully open position, display 30 is plainly visible. Display 30 can be concealed, if desired, by placing lid in the intermediate position shown in FIG. 3. Thus, there may be occasions where it is desired to conceal the display 30 of clock 10 and have clock 10 serve merely as a decorative object. When the lid is in the intermediate position shown in FIG. 3, boss 32 lightly contacts snooze bar 28. Snooze bar 28 has a downwardly depending portion 29 which contacts a resilient snap switch 34 which actuates the snooze function when depressed. Snap switch 34 is known per se, and need not be described in detail. Snap switch 34 has a certain amount of stiffness which must be overcome in order for the switch to operate. As long as the weight of lid 14 is less than the force required to operate snap switch 34, lid 14 will rest lightly on snooze bar 28, and snooze bar 28 will be in the off position.

Sufficient downward pressure anywhere on lid 14, such as the pressure of a user's finger or hand, will apply pressure to snooze bar 28 through boss 32. The downward pressure is, in turn, transmitted to snap switch 34 by downwardly depending portion 29. Sufficient downward pressure on lid 14 will overcome the stiffness of snap switch 34, and will press lid 14 into the fully closed position shown in FIG. 4. Hence, boss 32 will push snooze bar 28 downward against snap switch 34 and snap it into the on position, in which the snooze feature is activated.

It will be appreciated that, when clock 10 is in the alarm mode and the alarm is activated at the preset time, snooze bar 28 can be actuated easily by merely closing lid 14 and pressing on it until it is in the fully closed position. Alternatively, if lid 14 is already closed, simple pressure anywhere on the lid will actuate snooze bar 28, and it will not be necessary to open lid 14 in order to have access to and actuate snooze bar 28. There is no need for the user to fumble about in order to locate and press the snooze bar. Simply closing the lid and pressing on it, or simply pressing on the lid id the lid is already in the substantially closed position, is enough to activate the snooze feature. Of course, if the lid is in the fully open position, the user can also directly depress snooze bar 28 with a finger to activate the snooze feature.

The present invention may be embodied in other specific forms without departing from the spirit or essential attributes thereof and, accordingly, reference should be made to the appended claims, rather than to the foregoing specification, as indicating the scope of the invention.

I claim:

1. A clock having a snooze alarm, comprising a housing, including a depressible snooze actuator therein and movable between an off position and an on position, a lid hingedly connected to the housing, the lid containing a clock display, the lid having a portion thereof which contacts the snooze actuator in the off position when the lid is in a substantially closed position relative to the housing and which rests lightly on the snooze actuator and which depresses the snooze actuator into the on position when the lid is pressed into a fully closed position against the housing.

2. A clock according to claim 1, wherein the snooze actuator is resiliently biased into the off position by a snap switch.

3. A clock according to claim 1, wherein the portion of the lid which contacts the snooze actuator comprises a boss on an interior surface of the lid.

4. A clock comprising a decorative housing and a lid hingedly connected to the housing and movable between an open position and a closed position, the lid containing a clock display.

5. A table clock having a snooze alarm feature, comprising a decorative housing, a depressible snooze actuator in the housing and movable between an off position and an on position, the actuator being resiliently biased into the off position by a snap switch, a lid hingedly connected to the housing and movable between a fully open and a fully closed position, a clock display on an interior surface of the lid, the lid having a boss on the interior surface which contacts the snooze actuator in the off position when the lid is in a substantially closed position intermediate the fully open and fully closed positions and which rests lightly on the snooze actuator when in the intermediate position, and which depresses the snooze actuator into the on position when the lid is pressed into the fully closed position.

* * * * *